US008985000B2

(12) United States Patent
Frick

(10) Patent No.: US 8,985,000 B2
(45) **Date of Patent: *Mar. 24, 2015**

(54) METHOD AND DEVICE FOR TRANSMITTING ENERGY TO A PROJECTILE

(75) Inventor: Henry Roger Frick, Hettlingen (CH)

(73) Assignee: Rheinmetall Air Defence AG, Zurich (CH)

( * ) Notice: Subject to any disclaimer, the term of this patent is extended or adjusted under 35 U.S.C. 154(b) by 139 days.

This patent is subject to a terminal disclaimer.

(21) Appl. No.: 13/563,459

(22) Filed: Jul. 31, 2012

(65) Prior Publication Data

US 2014/0060297 A1 Mar. 6, 2014

Related U.S. Application Data

(63) Continuation of application No. PCT/EP2011/000390, filed on Jan. 28, 2011.

(30) Foreign Application Priority Data

Feb. 1, 2010 (DE) ..... 10 2010 006 529

(51) Int. Cl.
*F42C 17/04* (2006.01)
*F41A 21/32* (2006.01)
*F42C 11/00* (2006.01)

(52) U.S. Cl.
CPC ..... *F42C 17/04* (2013.01); *F41A 21/32* (2013.01); *F42C 11/008* (2013.01)
USPC ..... 89/6.5; 102/206; 102/209; 102/214; 102/215

(58) Field of Classification Search
USPC ..... 89/6.5; 102/206, 207, 209, 210, 212, 102/214, 215
See application file for complete search history.

(56) References Cited

U.S. PATENT DOCUMENTS

| | | | | |
|---|---|---|---|---|
| 2,691,761 | A * | 10/1954 | Smith, Jr. | 342/105 |
| 2,824,284 | A * | 2/1958 | Johnson | 342/104 |
| 3,994,228 | A | 11/1976 | Huerlimann | |
| 4,005,658 | A | 2/1977 | Karayannis | |
| 4,030,097 | A * | 6/1977 | Gedeon | 342/115 |

(Continued)

FOREIGN PATENT DOCUMENTS

| | | | |
|---|---|---|---|
| CH | 586 384 | A | 3/1977 |
| CH | 586 889 | A | 4/1977 |

(Continued)

OTHER PUBLICATIONS

Japanese Office Action for Japanese Application No. 2012-550373 dated Sep. 2, 2014—English translation.

*Primary Examiner* — Michael David
(74) *Attorney, Agent, or Firm* — Muncy, Geissler, Olds & Lowe, P.C.

(57) ABSTRACT

Inductive or capacitive transmission of energy to a projectile is disclosed. A waveguide can be used to transmit the energy, the electric field being concentrated in the waveguide. The thus used energy transfer system includes at least one waveguide which is arranged or integrated in the region of the muzzle, for example between a muzzle brake and a gun barrel. A transmission coupler for transmission is fed by a signal generator. The projectile comprises at least one sensor which captures the signal and a store in the projectile is charged. Assemblies of the system are used for a $V_0$ measurement as well as to program the projectile.

13 Claims, 4 Drawing Sheets

(56) References Cited

U.S. PATENT DOCUMENTS

| | | | | |
|---|---|---|---|---|
| 4,044,682 | A | 8/1977 | Karayannis | |
| 4,116,133 | A | 9/1978 | Beuchat | |
| 4,138,946 | A | 2/1979 | Postler et al. | |
| 4,142,442 | A | 3/1979 | Tuten | |
| 4,144,815 | A | 3/1979 | Cumming et al. | |
| 4,280,410 | A | 7/1981 | Weidner | |
| 4,283,989 | A * | 8/1981 | Toulios et al. | 89/6.5 |
| 4,495,851 | A | 1/1985 | Koerner et al. | |
| 4,649,796 | A | 3/1987 | Schmidt | |
| 4,928,523 | A * | 5/1990 | Muhrer et al. | 73/167 |
| 5,894,102 | A | 4/1999 | Oberlin et al. | |
| 6,598,533 | B1 | 7/2003 | Kölbli | |
| 7,506,586 | B1 | 3/2009 | Pereira et al. | |
| 7,825,850 | B2 | 11/2010 | Frick | |
| 8,305,071 | B2 * | 11/2012 | Frick | 324/160 |
| 8,746,119 | B2 * | 6/2014 | Frick | 89/6.5 |
| 2008/0211710 | A1 | 9/2008 | Frick | |
| 2009/0289619 | A1 | 11/2009 | Frick | |

FOREIGN PATENT DOCUMENTS

| | | | |
|---|---|---|---|
| DE | 488 866 | | 1/1930 |
| DE | 25 18 266 | A | 11/1975 |
| DE | 25 39 541 | A | 3/1977 |
| DE | 26 53 241 | A | 6/1977 |
| DE | 77 02 073 | A | 4/1978 |
| DE | 28 47 548 | | 5/1980 |
| DE | 31 50 172 | A | 6/1983 |
| DE | 22 64 243 | C2 | 1/1985 |
| DE | 199 41 301 | A | 12/2000 |
| DE | 698 11 187 | T2 | 7/2003 |
| DE | 103 41 713 | A | 6/2005 |
| DE | 10 2006 058375 | A1 | 6/2008 |
| DE | 10 2007 007 404 | A | 8/2008 |
| GB | 1 429 941 | | 3/1976 |
| WO | WO 2008/067876 | A1 | 6/2008 |
| WO | WO 2009/141055 | A1 | 11/2009 |

* cited by examiner

METHOD AND DEVICE FOR TRANSMITTING ENERGY TO A PROJECTILE

This nonprovisional application is a continuation of International Application No. PCT/EP2011/000390, which was filed on Jan. 28, 2011, and which claims priority to German Patent Application No. DE 10 2010 006 529.3, which was filed in Germany on Feb. 1, 2010, and which are both herein incorporated by reference.

BACKGROUND OF THE INVENTION

1. Field of the Invention

The invention relates to transmitting energy to a projectile during passage through the barrel and/or passage through the muzzle brake.

2. Description of the Background Art

For programmable ammunition, energy must be provided to the projectile for the electronics integrated therein and for starting of the detonating train. For this purpose, various rounds of ammunition have small batteries that supply the requisite energy. Others are programmed and supplied with energy before firing. If the energy quantity is available continuously, for example during storage or the process of loading in the weapon, undesired explosion of the projectile may occur in the event of a malfunction in the electronics. For this reason, the use of simple energy storage devices such as a battery is not always appropriate.

It is thus recommended for safety reasons to provide the energy to the projectile in close temporal proximity to firing, for example after the ignition of a propellant charge and before leaving the muzzle opening of a gun barrel. This ensures that the round of ammunition cannot detonate itself before firing, as it has no energy required for this purpose.

The battery from DE 31 50 172 A, which corresponds to U.S. Pat. No. 4,495,851, is not activated until after the projectile has left the gun barrel, which is accomplished by means that include a mechanical timer. The battery in DE 199 41 301 A, which corresponds to U.S. Pat. No. 6,598,533, also is first activated by high accelerations during firing.

According to DE 488 866, a capacitor of the detonator is charged via external contacts in the firing position. According to the teaching in DE 10 2007 007 404 A, an ignition capacitor is charged as early as following the end of muzzle safety, which is to say approximately two seconds before the end of the flight time. The ignition capacitor according to DE 26 53 241 A, which corresponds to U.S. Pat. No. 4,116,133, is charged inductively via magnet coils before firing.

U.S. Pat. No. 4,144,815 A describes a type of energy transmission device in which the gun barrel serves as a microwave guide, so that the energy and the data are transmitted prior to firing. A receiving antenna on the detonator receives the radiated signal and directs it through a changeover switch to either a rectifier device or a filter acting as a demodulator that filters the data out of the incoming signal. The rectifier device in this design serves to produce a supply voltage, which is then stored, from the incoming signal.

In DE 31 50 172 A, which corresponds to U.S. Pat. No. 4,495,851, the supply voltage is provided inductively before or during loading of the projectile.

Also known are devices that obtain the energy from the kinetic energy of the projectile. Here, a mechanism is built into the projectile that converts the required energy from the acceleration following ignition of the propellant charge into electromagnetic energy, and in so doing charges a storage device located in the projectile.

Thus, CH 586 384 A, which corresponds to U.S. Pat. No. 4,044,682, describes a method in which a soft iron ring and a ring-shaped permanent magnet are displaced in the direction of the projectile axis relative to an induction coil as a result of the linear projectile acceleration, by which means a voltage that charges a capacitor is generated in the coil. For the sake of safety, this unit is then provided in CH 586 889 A with a transport safety device that is destroyed only by the, or a, high acceleration during firing.

It can be a disadvantage here that the acceleration of the projectile in the gun barrel is used, since this cannot be controlled with exact precision. This causes the energy charges to vary, so that the projectile is given too much or even too little energy in its travel. Too little energy then has the disadvantage that functionality is not guaranteed. A further disadvantage is the complex and thus space-consuming conversion mechanism for converting mechanical energy into electromagnetic energy. Moreover, with the extreme environmental influences (shocks during firing, transverse accelerations, and spin) on the projectile during firing, this mechanism can be destroyed. In order to preclude this, design measures are necessary that not only make the round of ammunition costlier, but also require additional space in the projectile and make it heavier.

Generators in the projectile head are proposed in DE 25 18 266 A, which corresponds to U.S. Pat. No. 3,994,228, and DE 103 41 713 A. An alternative to these is the use of piezo crystals, as proposed and implemented in DE 77 02 073 A (which corresponds to U.S. Pat. No. 4,138,946), DE 25 39 541 A or DE 28 47 548 A (which corresponds to U.S. Pat. No. 4,280,410).

In this context, the latter proposals already take the route of replacing prior art energy conversion mechanisms with an energy transmission system that for its part impresses the necessary energy on the projectile no later than during passage through the muzzle opening.

SUMMARY OF THE INVENTION

It is therefore an object of the invention to provide a system that allows for optimal energy transmission with simple construction.

In an embodiment, the invention is based on the idea of carrying out the energy transmission inductively and/or capacitively. It is proposed to use a waveguide for the energy transmission, since the electromagnetic field in a waveguide is concentrated. The energy transmission system used here includes at least of a waveguide and a transmitting coupler for the energy transmission that is supplied by a signal generator. In contrast, the projectile has at least one sensor that receives the signal and charges a storage device in the projectile. The waveguide for the energy transmission can be the gun barrel, the muzzle brake, or an additional part between the end of the gun barrel and the start of the muzzle brake, or can also be attached to the end of the muzzle brake. Incorporation in the region of the opening between a muzzle brake and a gun barrel has proven to be preferred when a programming of the projectile or shell is provided, for example.

The signal generator (e.g., oscillator) supplies a signal with a constant center frequency that lies below the lowest cutoff frequency of the waveguide. As a function of the geometry and type of the transmitting coupler (coil, dipole, etc.), multiple waveguide modes ($TE_{mn}$ where m=0, 1, 2, . . . and n=1, 2, 3, . . . ) are excited. The signal generator generates either a carrier in continuous-wave operation (CW operation) or a modulated signal.

The utilization of a waveguide below the cutoff frequency to measure the muzzle velocity of a projectile or the like is already known from DE 10 2006 058 375 A. This document proposes using the gun barrel or launcher tube and/or parts of the muzzle brake as a waveguide (a tube with a characteristic cross-sectional shape that has a wall with very good electrical conductivity is considered a waveguide. Primarily square and round waveguides are widely used as a technology), which, however, is operated below the cutoff frequency of the applicable waveguide mode. However, a utilization as energy transmission system is not addressed.

In a further embodiment of the invention, provision is made to additionally use the waveguide for the $V_0$ measurement and not for the energy transmission alone. The muzzle velocity itself preferably can be measured or determined before and/or after the projectile. In the case of measurement before the projectile, the fact is taken into account that the tip of the projectile influences the magnetic field when passing through the waveguide. In the case of measurement after the projectile, the essentially flat or planar surface of the base is exploited, by which means the measurement takes place independently of the shape of the tip of the projectile. In this process, the base influences the electromagnetic field. In each case, this change is sensed by a receiving coupler in the waveguide and supplied to an analysis device. Such a method is known from WO 2009/141055 A1, which corresponds to US 20090289619, which are incorporated herein by reference. The distance between a transmitting coupler, which for its part receives the signals from the oscillator, and the receiving coupler is variable and can be chosen individually as a function of the mode selection of the waveguide, but depends on the caliber, the interior dimensions of the waveguide, and the frequency.

Furthermore, the energy transmission can be combined with a programming of the projectile, which itself is the subject matter of a parallel patent application. For programmable rounds of ammunition, the information must be communicated to the projectile concerning its detonation time and/or flight path. The signal with the frequency for the programming is also below the cutoff frequency of the applicable waveguide mode here. So that the programming is independent of the magnitude of the muzzle velocity $V_0$, the frequency should also be >0 Hz here. This has the result that the $V_0$ of slow projectiles as well as fast projectiles has no effect on the programming. The carrier with the frequency is modulated with the applicable information for the projectile, and the modulated signal is then provided to the transmitting coupler in the waveguide. The transmitting coupler now excites the corresponding electromagnetic field in the waveguide. When the projectile passes through the waveguide, the projectile receives the signal in a contactless manner with capacitive and/or inductive coupling by means of a receiving coupler located in the projectile. It is a matter of course that the device for the energy transmission is to be incorporated ahead of the device for programming, and that the spacing of the two is to be chosen such that the programming can also proceed successfully.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
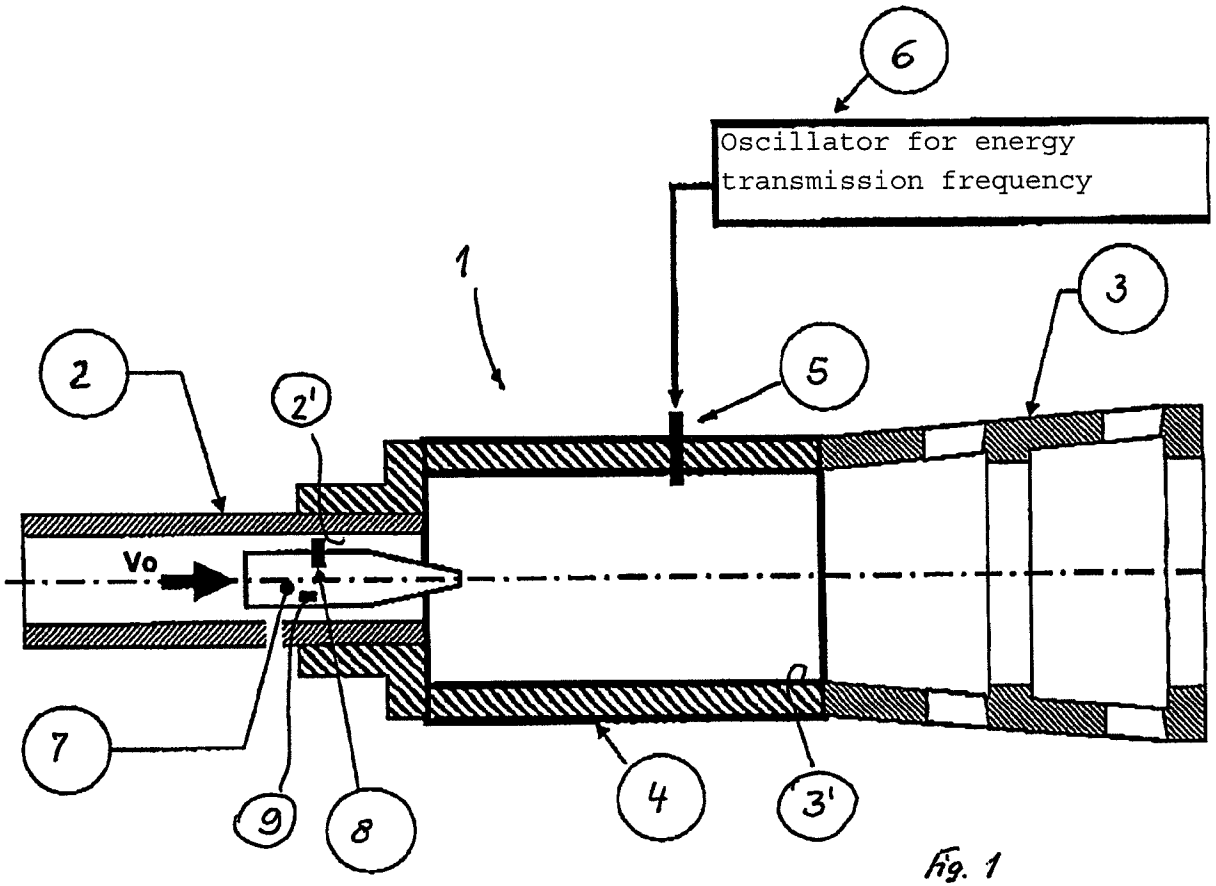
FIG. 1 illustrates an energy transmission system.

FIG. 1 shows an energy transmission system 1, here incorporated between an end 2' of a gun barrel 2 and a muzzle brake 3 (not a necessary condition). The energy transmission system 1 having at least one waveguide 4 (and/or waveguide segments), and at least of a transmitting coupler 5 that is supplied with a frequency $f_2$ by an oscillator 6. The reference number 7 identifies a projectile to which energy is to be transmitted during passage through the energy transmission system 1. The waveguide 4 in this design can be the start 3' of the muzzle brake 3 or can be a component of the end of the gun barrel 2. In this example, the waveguide 4 is a separate part that is incorporated between the gun barrel 2 and the muzzle brake 3.

Figure 2:
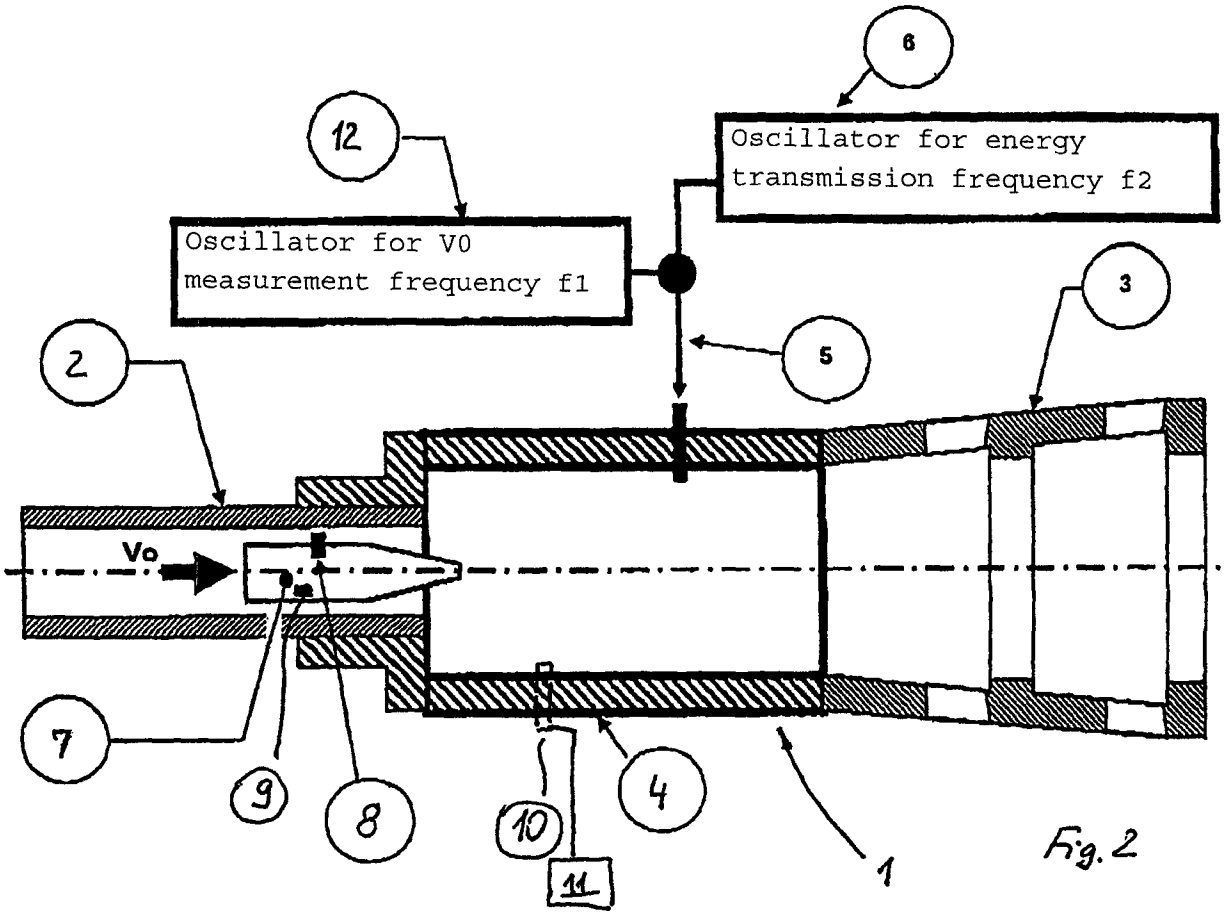
FIG. 2 illustrates the energy transmission system in a combination with a $V_0$ measurement.

FIG. 2 shows the energy transmission system 1 from FIG. 1 in combination with a $V_0$ measurement. In the preferred embodiment, the same transmitting coupler 5 is used for the $V_0$ measurement. The reference number 10 indicates a receiving coupler in the waveguide 4 that is required for the $V_0$ measurement and that is electrically connected to an analysis device 11. An additional oscillator 12 supplies an additional signal with a frequency $f_1$ for the $V_0$ measurement.

The mode of operation or the method is now explained in general with reference to the preferred embodiment from FIG. 2, which is to say in a possible combination of $V_0$ measurement and energy transmission:

The signal with the frequency $f_1$ is provided for the $V_0$ measurement, and the signal with the frequency $f_2$ is provided for the energy transmission. Both frequencies $f_1$ and $f_2$ are below the cutoff frequency of the relevant waveguide mode, and thus are lower than the cutoff frequency. In addition, it can be the case that $f_1 \neq f_2$ or $f_1 = f_2$.

The frequencies $f_1$ and $f_2$ preferably are optimized for both the $V_0$ measurement and energy transmission when the frequency used for both the measurement and the energy transmission (the same $f_1 = f_2$) is already optimal. So that both the measurement and the energy transmission are independent of the magnitude of $V_0$, the frequencies should be >0 Hz. This has the effect that the $V_0$ of slow projectiles as well as fast projectiles is always measured with the same precision, which is also true with respect to the energy transmission.

When the projectile 7 passes through the waveguide 4, the muzzle velocity $V_0$ can be measured in a known manner before and/or after the transmission of energy. For the energy transmission, the projectile 7 has a sensor 8 that receives the signal with the frequency $f_2$ and charges a storage device 9 in the projectile 7. As it flies through, the projectile 7 receives the requisite quantity of energy so that the storage device 9 is charged after leaving the waveguide 4.

Figure 3:
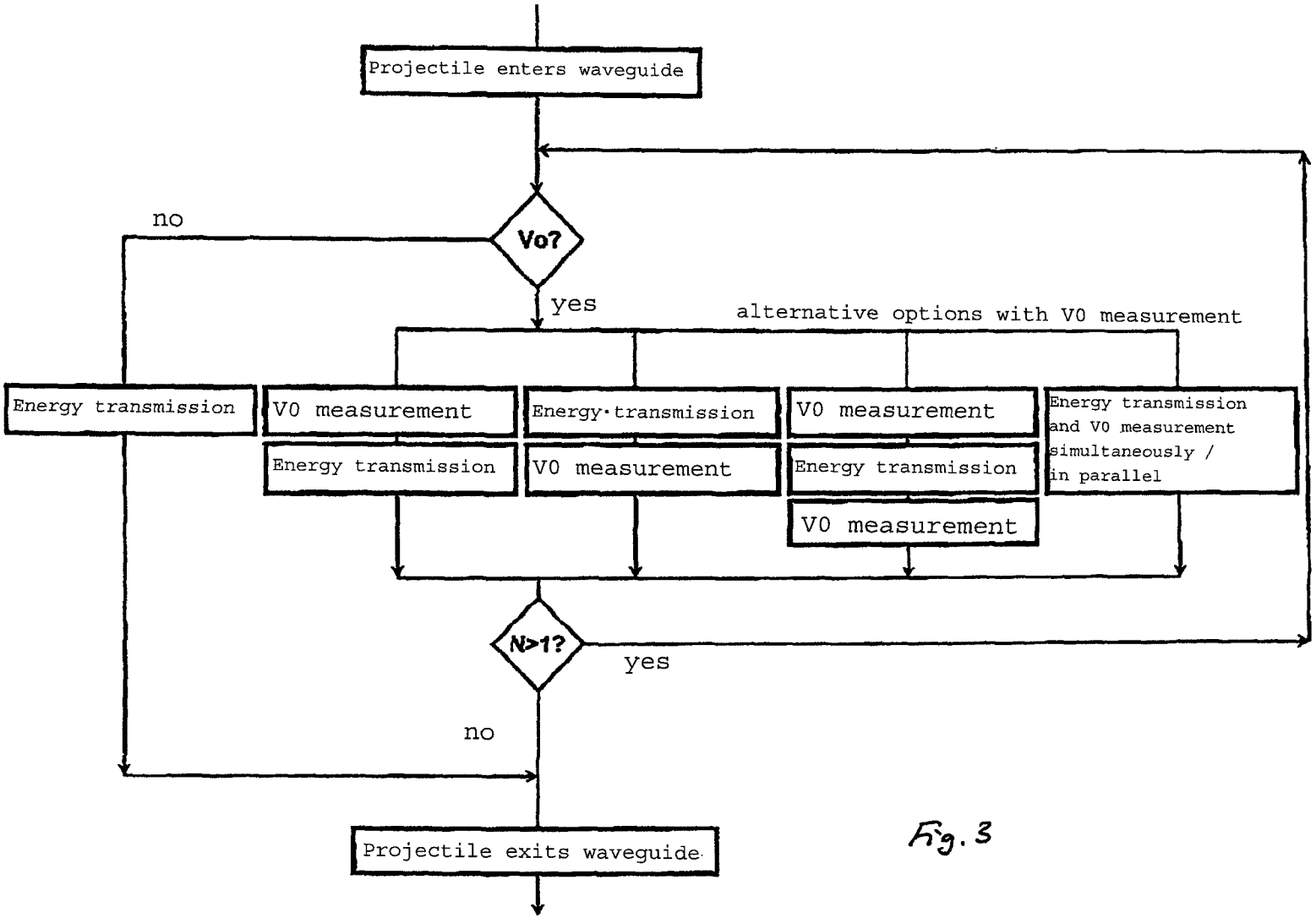
FIG. 3 is a flow chart for illustrating the sequence of energy transmission and/or $V_0$ measurement.

FIG. 3 shows an overview of the sequence of the energy transmission, also in combination with the $V_0$ measurement. If no $V_0$ measurement is provided, only the path "energy transmission" is chosen. In contrast, if the intent is for both the measurement and the energy transmission to take place using the same waveguide, then four different alternative methods are available: first the $V_0$ measurement followed by the energy transmission, or first the energy transmission followed by the $V_0$ measurement, or the energy transmission preceded and followed by respective $V_0$ measurements, or a parallel $V_0$ measurement and energy transmission. If the number of components/waveguides permits, the steps with the energy transmission or $V_0$ measurement can be performed multiple times until the shell or projectile 7 exits the waveguide 4 and subsequently passes through the muzzle brake, for example.

Figure 4:
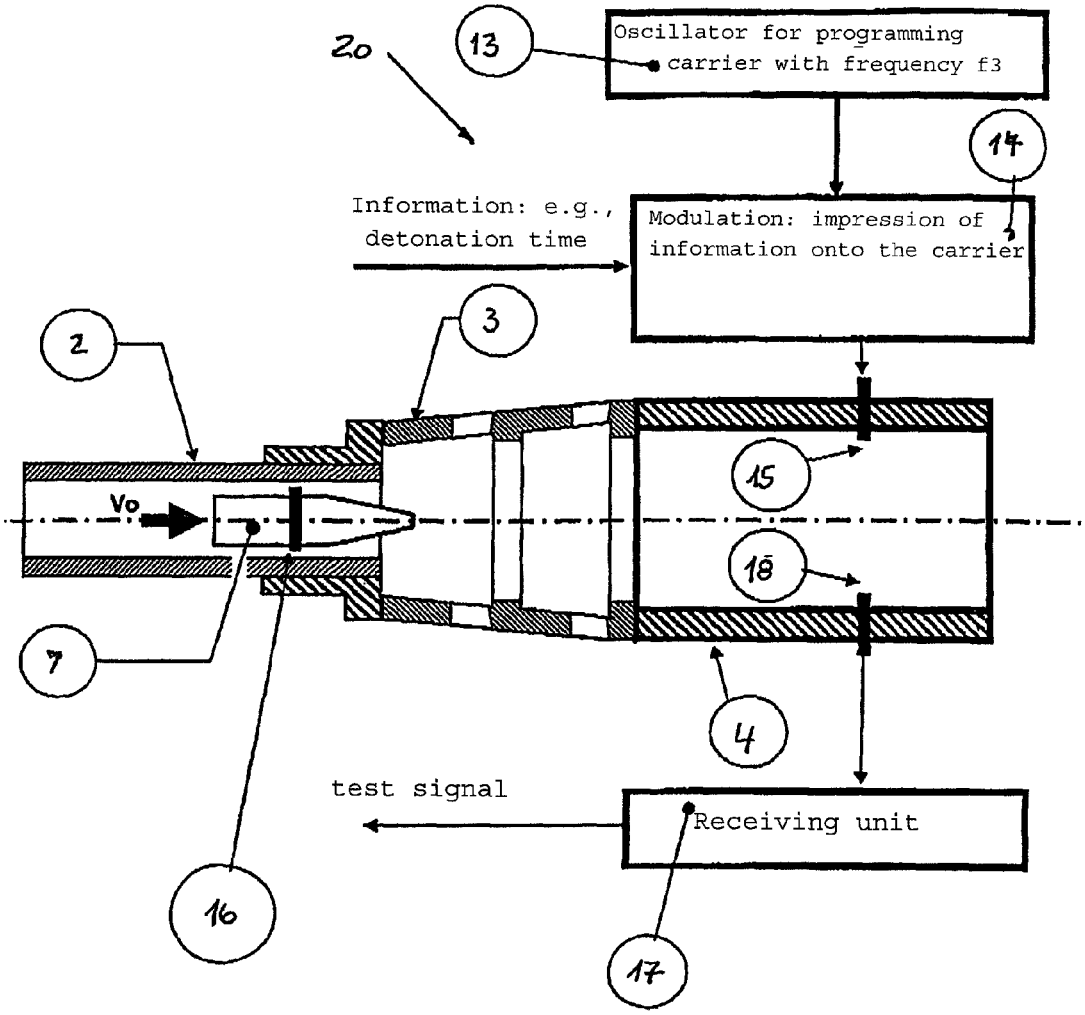
FIG. 4 illustrates a further development with projectile programming.

FIG. 4 shows augmentation with a programming device 20. In this case, said programming device can likewise use the transmitting coupler 5 that is already present for the $V_0$ measurement and/or energy transmission for the programming. Preferably, an additional signal generator 13 produces the carrier signal $f_3$ for the programming. The information for the shell or projectile is then modulated 14 onto said carrier signal and is impressed on or transmitted to a receiving coupler 16 contained in the projectile 7 via the transmitting coupler 5 or via an additional transmitting coupler 15. An additional receiving unit 17, which is electrically connected to a receiving coupler 18 in the waveguide region 4, can serve to provide a test signal for the correct programming.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for transmitting energy to a projectile during passage of the projectile through a gun barrel or muzzle brake, via an energy transmission system, the method comprising:

impressing a frequency produced by a signal generator for the energy transmission on the projectile during its passage, charging, via the impressing, the projectile with energy; and performing the impressing entirely during passage through a waveguide that is operated below a cutoff frequency of an applicable waveguide mode.

2. The method according to claim 1, wherein a $V_0$ measurement of the projectile is performed in the waveguide via a frequency generated for the measurement.

3. The method according to claim 2, wherein an appropriate electromagnetic field is excited in the waveguide so that the frequency is reflected at the projectile and analyzed.

4. The method according to claim 1, wherein a programming of the projectile in the waveguide, via information generated for the programming and modulated onto this carrier frequency, is performed and is transmitted to the projectile.

5. The method according to claim 4, wherein a carrier of the frequency for the programming is modulated with the appropriate information for the projectile, and wherein the modulated signal is transmitted to the projectile in a contactless manner via capacitive and/or inductive coupling.

6. The method according to claim 1, wherein the frequency is greater than 0 Hz.

7. A device for transmitting energy to a projectile during passage of the projectile through a gun barrel and/or muzzle brake via an energy transmission system, the device comprising:

a waveguide that is operated below a cutoff frequency of an applicable waveguide mode; and a transmitting coupler that, during the passage of the projectile, impresses a frequency produced by a signal generator for the energy transmission onto the projectile via a sensor, via which a storage device integrated into the projectile is charged with energy.

8. The device according to claim 7, wherein the transmitting coupler and at least one receiving coupler are incorporated into the waveguide for measuring a muzzle velocity $V_0$ of the projectile, and wherein an additional signal generator is connectable to the transmitting coupler.

9. The device according to claim 8, wherein the transmitting coupler used by the energy transmission serves as the transmitting coupler.

10. The device according to claim 7, wherein a signal generator that is connectable in signaling terms via a modulation unit to the transmitting coupler or to an additional transmitting coupler, is incorporated for programming the projectile, and wherein the projectile comprises an additional receiving coupler.

11. A device for transmitting energy to a projectile during passage of the projectile through a gun barrel and/or muzzle brake via an energy transmission system, the device comprising:

a waveguide that is operated below a cutoff frequency of an applicable waveguide mode; and a transmitting coupler that, during the passage of the projectile, impresses a frequency produced by a signal generator for the energy transmission onto the projectile via a sensor, via which a storage device integrated into the projectile is charged with energy, wherein the transmitting coupler and at least one receiving coupler are incorporated into the waveguide for measuring a muzzle velocity $V_0$ of the projectile, wherein an additional signal generator is connectable to the transmitting coupler, and wherein the projectile is programmable through the waveguide.

12. The method according to claim 1, wherein the waveguide is provided between the gun barrel and the muzzle brake.

13. The device according to claim 7, wherein the waveguide is provided between the gun barrel and the muzzle brake.

* * * * *